United States Patent [19]

Harasek

[11] 3,939,751

[45] Feb. 24, 1976

[54] TUNABLE ELECTRICAL MUSICAL INSTRUMENT

[75] Inventor: Richard J. Harasek, Northbrook, Ill.

[73] Assignee: Motorola, Inc., Chicago, Ill.

[22] Filed: Sept. 16, 1974

[21] Appl. No.: 506,072

[52] U.S. Cl. ..... 84/1.17; 84/1.01; 84/DIG. 11

[51] Int. Cl.[2] ..... G10H 5/06

[58] Field of Search ..... 84/1.01, 1.03, 1.17, 1.22, 84/1.23, DIG. 11

[56] References Cited

UNITED STATES PATENTS

| | | | |
|---|---|---|---|
| 3,236,931 | 2/1966 | Freeman | 84/1.23 |
| 3,821,460 | 6/1974 | Maynard | 84/1.17 |
| 3,842,702 | 10/1974 | Tsundoo | 84/1.01 |
| 3,861,266 | 1/1975 | Whitaker | 84/1.01 X |

*Primary Examiner*—George H. Miller, Jr.
*Assistant Examiner*—Stanley J. Witkowski
*Attorney, Agent, or Firm*—James W. Gillman; Eugene A. Parsons

[57] ABSTRACT

An electronic musical instrument including two or more keyboards individually capable of selecting, simultaneously, any twelve out of at least 1,024 discrete pitches per octave to produce scales of twenty-four or more notes per octave using conventional keyboards. It can also produce two or more completely independent tones with a specific pitch or phase difference between them for research in music theory, music history, ethnomusicology, acoustics, and monaural and binaural beats.

5 Claims, 7 Drawing Figures

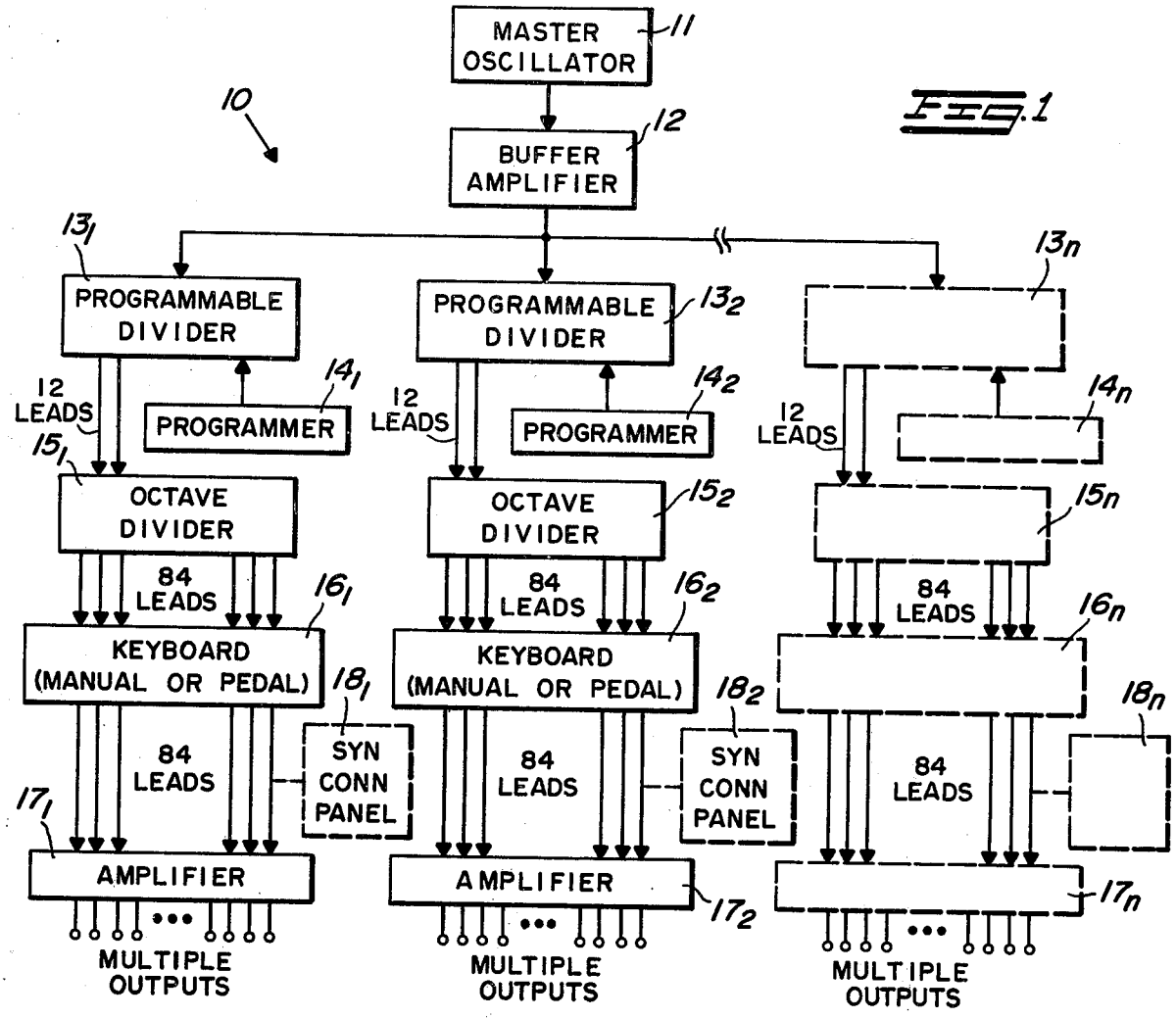
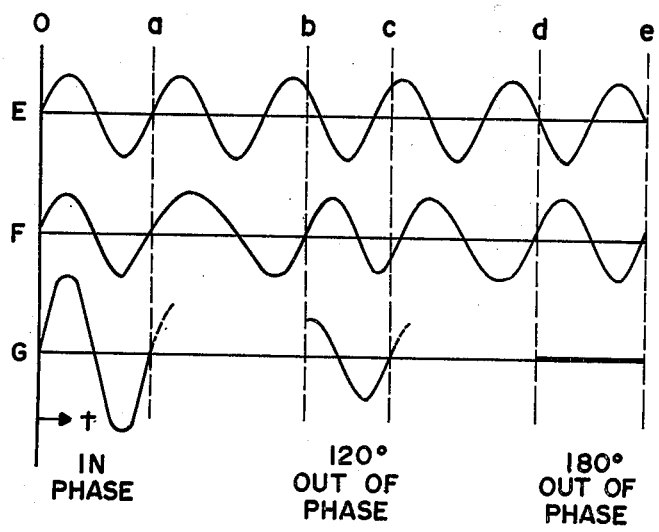
FIG. 5
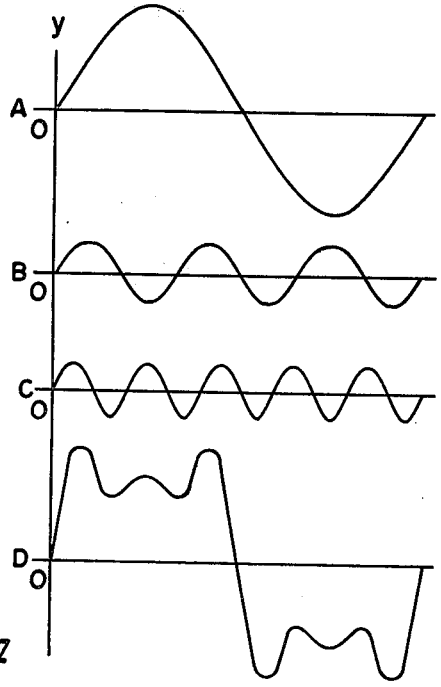
FIG. 4

| | | | | | | | | | | | | |
|---|---|---|---|---|---|---|---|---|---|---|---|---|
| (a) JUST SCALE NOTE. | C | C# | D | D# | E | E# | F# | G | G# | A | A# | B# |
| (b) PITCH. | 261.5 | 272.5 | 294.6 | 306.5 | 327.1 | 340.8 | 368.0 | 392.8 | 408.6 | 437.0 | 460.1 | 511.1 |
| (c) CENTS UP FROM REF. | 0 | 70 | 204 | 274 | 386 | 456 | 590 | 702 | 772 | 884 | 976 | 1158 |
| (d) PROGRAM No. | 338 | 406 | 529 | 588 | 680 | 735 | 832 | 909 | 953 | 0 | 103 | 297 |
| (e) | | | 1 | | | 1 | | 1 | 1 | | 1 | 1 |
| | 2 | 2 | | | | 2 | | | | | 2 | |
| | | 3 | | 3 | | 3 | | 3 | | | 3 | |
| | | | | 4 | 4 | 4 | | 4 | 4 | | | 4 |
| | 5 | 5 | 5 | | | 5 | | | 5 | | | |
| | | | | | 6 | | | | 6 | | 6 | 6 |
| | 7 | | | 7 | | 7 | 7 | | | | 7 | |
| | | 8 | | | 8 | 8 | | 8 | 8 | | | |
| | 9 | 9 | | | | | 9 | 9 | 9 | | | 9 |
| | | | 10 | 10 | 10 | 10 | 10 | 10 | 10 | | | |

I

FIG. 3

| | | | | | | | | | | | | |
|---|---|---|---|---|---|---|---|---|---|---|---|---|
| (a) JUST SCALE NOTE. | C | D^b | D | E^b | E | F | G^b | G | A^b | A | B^b | B |
| (b) PITCH. | 261.5 | 279.1 | 294.6 | 314 | 327.1 | 349.0 | 377.0 | 392.8 | 418.6 | 437.0 | 471.0 | 490.6 |
| (c) CENTS UP FROM REF. | 0 | 112 | 204 | 316 | 386 | 498 | 632 | 702 | 814 | 884 | 1018 | 1088 |
| (d) PROGRAM No. | 338 | 445 | 529 | 623 | 680 | 766 | 861 | 909 | 979 | 0 | 148 | 224 |
| (e) | | 1 | 1 | 1 | | | 1 | 1 | 1 | | | |
| | 2 | | | 2 | | 2 | | | 2 | | | |
| | | 3 | | 3 | | 3 | 3 | 3 | | | 3 | |
| | | 4 | | 4 | 4 | 4 | 4 | 4 | | | | |
| | 5 | 5 | 5 | | | 5 | 5 | | 5 | | 5 | |
| | | 6 | | 6 | 6 | 6 | | | | | | 6 |
| | 7 | | | 7 | | 7 | 7 | | 7 | | | 7 |
| | | 8 | | | 8 | 8 | | 8 | 8 | | 8 | 8 |
| | 9 | 9 | | | | | 9 | 9 | 9 | | | |
| | | | 10 | 10 | 10 | 10 | 10 | 10 | 10 | | | |

II

TUNABLE ELECTRICAL MUSICAL INSTRUMENT

BACKGROUND

FIELD OF THE INVENTION

This invention relates to tunable electronic musical instruments of the keyboard type and particularly to the capability of producing scales having 24 or more pitches in each octave or producing, simultaneously, at least two of the many twelve note scales needed for teaching, research, performance and composition.

In contemporary music composition and performance the use of microtonal scales (scales having more than twelve notes per octave) is of increasing importance. There are various instruments on the market, such as the synthesizers, which can produce such scales, but all of them have some of all of the following disadvantages. Each pitch must be established, then recorded, the next pitch established and recorded, and so on in sequence. Pitches are not drift free, thus constant rechecking of pitch is required. Only the recording becomes a "performance" as it is virtually impossible to perform "live" on such instruments. Also, they are not playable by normal keyboard techniques, and require much specialized training by the potential user.

In the past, research and teaching in music theory of such subjects as harmonics and intervals has usually involved the use of laboratory-type setups including a multiplicity of oscillators, amplifiers, speakers and such. Accuracy was limited and difficult to prove. Phonograph records were often used in the classroom to avoid the laboratory setup but this technique restricted the instructor's scope in teaching and was also limited in accuracy. Again, in music history, records were often resorted to in order to study the scales of intricate, expensive or even extinct authentic instruments. Thus, the teaching of music history has tended to have a dull textbook approach. And this problem is not new. Marin Mersenne, seventeenth century authority on tuning, in his "Harmonie Universelle" and other works, provides descriptions of many scales with more than twelve notes per octave and sketches of complicated key-boards on which to play them. Few if any of them were practical designs, and of course, each instrument would have been difficult to tune and impossible to tune accurately.

A leading musicologist of the present day, J. Murray Barbour, in his "Tuning and Temperament" lists 179 different historical scales from the Western world alone, and describes many of the interesting attempts to make these scales available on an actual instrument. As an example, Georg Frederick Handel played on a number of English organs with split keys which had been designed in an attempt to obtain improved tuning. Almost without exception these instruments were still limited to one particular scale.

In ethnomusicology, volumes have been and are being written on the music of various contemporary cultures. In some cultures the musical scales vary from village to village. Reproduction of these was very difficult unless the authentic instruments for each village were available.

The study of the physics of sound and music can be greatly facilitated by the capability of producing on a keyboard instrument two or more tones with exactly controllable pitch or phase difference between them. The study of "monaural" beats is a vital part of acoustic research but is also necessary in music training for learning to tune instruments such as the violin, to play "in tune" on instruments such as the clarinet, and to train the young musician's ear to hear perfect intervals. A new field of research is that of "binaural" beats, where two signals are fed to a subject's ears with absolutely no electronic or acoustic mixing of the signals. In the past, such research has used two cellos in separate rooms, with separate microphones and amplifiers, each fed to one headphone. (See "Some Aspects of Binaural Sound," Charles J. Hirsch, RCA, IEEE Spectrum, Feb. 1967, pages 80–85.) Even when oscillators were substituted for the two cellos the problems of exact control and measurement were almost insurmountable. (See "Auditory Beats in the Brain," Gerald Oster, Scientific American, Oct. 1973, pages 94–102, and "Limits for the Detection of Binaural Beats," D. Perrott and M. Nelson, The Journal of the Acoustical Society of America, Dec. 1969, pages 1,477–1,481.)

In the field of music history many important scales have had other than 12 notes to an octave, varying from the Greek tetrachord with 4 notes to at least 31 notes in the Meantone temperaments. In ethnomusicology, many scales of recent or current cultures involve more than 12 notes to the octave. Contemporary musicians are composing in many of these scales and in others such as quarter tone, third tone, and various microtonal scales such as those with 13, 17, 23 or 53 notes per octave. There has been a widespread and previously unmet demand for an instrument with such capabilities.

Although many devices and systems have been devised to solve one or more of the above problems most of them lack the accuracy and simplicity which make the present invention desirable. All of them lack the reproducibility and real time accessibility which is vital to much teaching and research.

Likewise, many systems of notation have been devised in the attempt to provide for these many scales, but no single system was devised that would satisfy all requirements.

PRIOR ART

In a U.S. Pat. No. 3,821,460, granted to Fred B. Maynard and assigned to the assignee of the present invention, there is disclosed an instrument having a single programmable section and a section limited to providing a conventional twelve tone equal temperament scale. This limitation proves a serious one in a view of the need for scales with more than twelve tones per octave and while the aforementioned instrument can compare any twelve tone scale with the present equal temperament scale, it can only compare with that scale. The Maynard instrument can produce only a single useful microtonal scale, the quartertone scale. Since one half of the instrument can produce only the intervals of the conventional equal temperament scale, it is impossible to reproduce any other of the wide variety of scales using more than twelve notes per octave. This same limitation also prevents a teacher from, for example, comparing any two or more different scales of the past or present. Also, the electronic addition of the two signals in one adder-amplifier-speaker combination is a very real limitation in many areas of research. Thus there is a definite need for two completely isolated signals having the same frequency source, along with the desired phase and pitch control characteristics.

SUMMARY

It is therefore an object of the present invention to provide an improved electronic musical instrument capable of producing with facility, accuracy and exact reproducibility a wide range of musical scales including those with more or less than the usual twelve notes per octave.

It is a specific object of this invention to provide such an instrument with normal keyboard accessiblity and only a slight addition to normal musical notation.

It is another specific object of this invention to provide two or more completely isolated signals from one fixed frequency reference source for study and research as well as performance.

It is a particular object of the invention to provide a means of producing "live" polyphonic sound for study, composition and performance in historical, ethnic and modern microtonal scales.

The present invention is an electronic musical instrument comprising two or more tunable keyboards with completely isolated outputs, all pitches being derived from a single fixed-frequency reference source. Each keyboard provides a choice of twelve simultaneous pitches per octave out of at least 1,024 distinct pitches, with increments of approximately one cent. Thus two keyboards are capable of providing almost any desired musical scale with as many as 24 notes per octave. Three keyboards provide 36 notes per octave, etc. As far as the performer is concerned, this requires no new keyboard technique. It also requires no special musical notation but merely a designation such as "program number" to denote the pitch to be programmed and played on a particular key switch on a manual or pedal board. The instrument can be very quickly tuned to a new scale, typically requiring less than one minute per manual or pedal board. Once set, the pitches are virtually drift free, and any pitch can be reproduced accurately at any subsequent time.

With this combination of exact fixed pitches, very small increments between pitches, and two or more separate channels, a wide variety of study and research projects in now made possible, especially with monaural and binaural beats and with the harmonic series.

In the study of acoustics and the physics of music, it is also a great advantage to have available two or more outputs of the same or different pitches with any desired phase difference between them.

BRIEF DESCRIPTION OF DRAWING

FIG. 1 is a block diagram of a system using a preferred embodiment of the invention.

FIG. 3 shows a suggested program for a nineteen note Just scale using two standard keyboards.

FIG. 4 is a diagram of a complex wave form showing the addition of a fundamental and its third and fifth harmonics, as it could be seen on a visual display device.

FIG. 5 is a diagram showing addition of two signals identical in frequency, but with varying phase relationships.

DETAILED DESCRIPTION OF AN EMBODIMENT OF THE INVENTION

Figure 2:
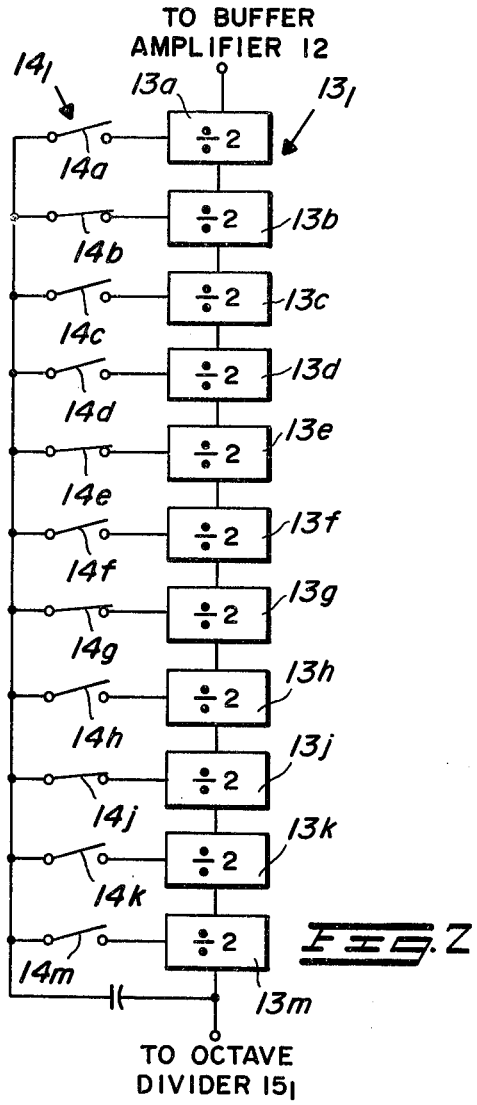
FIG. 2 is a block diagram of an embodiment of a programmable divider and a programmer, as it would appear when used to produce a Middle C of 261.5 Hz.

First is given an explanation of some of the less common terms used in the specification. "Microtonal scales" is a term used loosely to include all scales having more than twelve notes per octave. "Monaural beats" are pulsations caused by the mixing or addition, electrically or in air, of two audio signals having similar frequencies. These are usually called merely "beats" but the term monaural beats is used when necessary to distinguish them from binaural beats or "dichotic beats". These latter terms are used to designate beats which are developed in the auditory system of the brain as a result of hearing one frequency in one ear, and another, similar in frequency but completely isolated, in the other ear. "Polyphonic" music is the playing of more than one sound or note at the same time, not necessarily as chords. The "cent" is a linear unit used for the interval of one-twelve hundredth of an octave. The ratio of the two pitches or frequencies forming the interval of one cent is 1.0005778 to 1.0. A whole tone is 200 cents; an octave is 1,200 cents. A "Just" scale is an ancient scale having perfect thirds and perfect fifths. In order to make this possible in all keys, an enharmonic scale of 19 tones is required.

FIG. 1 is a block diagram of a master unit of an embodiment of the invention. A master oscillator 11 (crystal controlled in normal use but variable when desired) supplies a high frequency output to a buffer amplifier 12 the output which goes to programmable dividers $\mathbf{13}_1 \ldots \mathbf{13}_n$. Also fed to each of the programmable dividers is the output of a corresponding programmer $\mathbf{14}_1 \ldots \mathbf{14}_n$. Each programmer can simultaneously program twelve different pitches out of a possible 11,024 or more into the corresponding programmable dividers $\mathbf{13}_1 \ldots \mathbf{13}_n$, with the smallest increment of difference being less than one cent. The programmable dividers and programmers operate in the manner disclosed in the U.S. Pat. No. 3,821,460, referred to above. (See also FIG. 2 and its description below.) Each programmable divider feeds its twelve pitches into a corresponding octave divider $\mathbf{15}_l \ldots \mathbf{15}_n$ from which are derived the lower octaves for each pitch. Each octave divider has eighty-four output signals which are fed to a corresponding keyboard $\mathbf{16}_l \ldots \mathbf{16}_n$ (manual or pedal board) wherein key switches (not shown), upon being actuated, apply the desired pitches to a corresponding amplifier $\mathbf{17}_l \ldots \mathbf{17}_n$. Each amplifier has a plurality of output terminals having impedances suited to a variety of possible applications. An optional synthesizer connector panel $\mathbf{18}_l \ldots \mathbf{18}_n$ which could be any one of a number known in the art, may be connected to the output of each keyboard $\mathbf{16}_l \ldots \mathbf{16}_n$ to provide 84 separate outputs for such purposes as tonal synthesizing. It should be noted that although one octave divider has 84 outputs in this embodiment, any number may be used, depending upon the frequency range of the instrument, and still fall within the scope of the invention.

FIG. 2 is a block diagram of an embodiment of one portion of one programmable divider 13 with the corresponding portion of its programmer 14, as it would appear when programmed for a Middle C of 261.4 Hz. In this embodiment it is assumed that the frequency of the master oscillator 11 is such that a divisor number of 1,710 is required to provide an output frequency to the octave divider 15 that is proportional to the Middle C frequency 261.5. There are eleven binary dividers, $13_a$. . . $13_m$, in each programmable divider 13 therefore the maximum divisor is 2,048 or $2^{11}$. If all of the divide-by-two dividers are set to the zero state, a "1" will be provided by the output divider, therefore division by 2,048 is desired, as would be required for a higher pitch, a number corresponding to the difference between 2,048 and the desired divisor must be preprogrammed into the divider chain. In this example the divisor number required is 1,710 and the difference between 1,710 and 2,048 is 338. In binary form the number 338 is 00101010010. Closing the switches of programmer 14 which correspond to the ones of the binary number (14*b*,14*e*, 14*g*, 14*j*) provides the appropriate feedback and thus presets the programmable divider so that division by 1,710 is achieved. The resulting frequency is then divided in the octave divider and, upon actuation of the Middle C key of the keyboard 16, an output at 261.5 Hz would be available at the output.

FIG. 3 is in two parts and shows a suggested program for a nineteen note Just scale using two standard keyboards. Since twenty-four keys per octave are available, the most-used are programmed on both keyboards. Line (*a*) in each part gives the name of a note in the enharmonic Just scale. Line (*b*) gives the pitch. Line (*c*) gives the interval in "Cents up from reference," the reference in this case being Middle C. Line (*d*) is the program number which is related to the divisor number of the programmable dividers $13_l$. . . $13_n$ by the formula:

Pitch = oscillator frequency/(2,048 − program number)

Next is (e) which shows the pattern of switches in the two programmers $14_1$, $14_2$ of this embodiment that are to be depressed to obtain the desired pitches. There are two switch panels for access to the programmers, each panel comprising twelve columns and ten rows of switches. Each column of switches programs one set of octave-related keys; e.g., the first column on the left of one panel programs all of the C keys on one keyboard. In this embodiment the top switch of a column represents the units place of the binary number. The bottom switch represents the 512's place. The switch representing 1,024 is not on the front panel of the embodiment. The switches to be depressed for the Just scale of FIG. 3 are indicated in (*e*) by a darkened outline and a row number. FIG. 4 is a graph of the output of the instrument with a given pitch (shown as A) programmed on one of the Keyboards 16 and two of its harmonics (shown as B,C) programmed on a second of the Keyboards 16 at approximately one third the amplitude of the fundamental, and in the same phase. Other phase relatiionships are easily obtained and maintained. The bottom wave form (D) shows the addition of the three. This is a simple example of the many possible studies using the harmonics series in music theory. FIG. 5 shows wave forms as used in a study of phase relationships and cancellation in acoustics. (E) is the signal programmed into the programmable divider $13_1$ and maintained throughout the study. (F) is the signal programmed into the programmable divider $13_2$, (G) is the wave shape of (E) and (F) combined at the points of interest. (E) and (F) are maintained throughout at identical amplitudes. Initially, $t=0$, (E) and (F) are identical frequencies and (G) is double the amplitude of (E) or (F). Then, at $t=a$, (F) is reprogrammed to a lower frequency. When (F) is leading or lagging by the desired angle, in this case lagging by 120° ($t=b$), (F) is reprogrammed to the original program. Now (G) has the same amplitude as (E) and (F) with phase midway between, i.e., lagging by 60°. At t=c, (G) is again reprogrammed to a lower frequency and switched back to the original at the point (d) when (E) and (F) are 180° out of phase, and (G) is of essentially zero amplitude. To carry out the study, one portion of the divider $13_1$ would be programmed by its programmer $14_1$ with a suitable pitch as described hereinbefore, and this program would be maintained unchanged throughout the study. One portion of the divider $13_2$ would be identically programmed. Suitable output terminals of amplifiers $17_1$ and $17_2$, respectively, would be connected to an instrument capable of visually displaying multiple voltage waveforms individually as well as in summation. Alternatively, suitable output terminals could be connected to a pair of audio transducers such as loudspeakers. The program for divider $13_2$ would be changed by depressing or releasing (closing or opening) one of the top two switches in the divider portion. While this is not a strict requirement, it is preferable to make an incremental change in the pitch of one output signal in this way. Visually displayed, one signal would then be seen to drift with respect to the other as the amplitude of the voltage sum would increase or decrease at the difference frequency when one program is changed. When the second signal is in the desired phase relationship with the first signal, the program of the second is restored to the original program. Acoustically presented, the resultant sound level will rise and fall at the difference frequency rate while the programs are non-identical, and, when identical, the level will remain constant at some point between a maximum and a near zero point, depending on the phase relationship, as is shown in FIG. 5.

Figure 7:
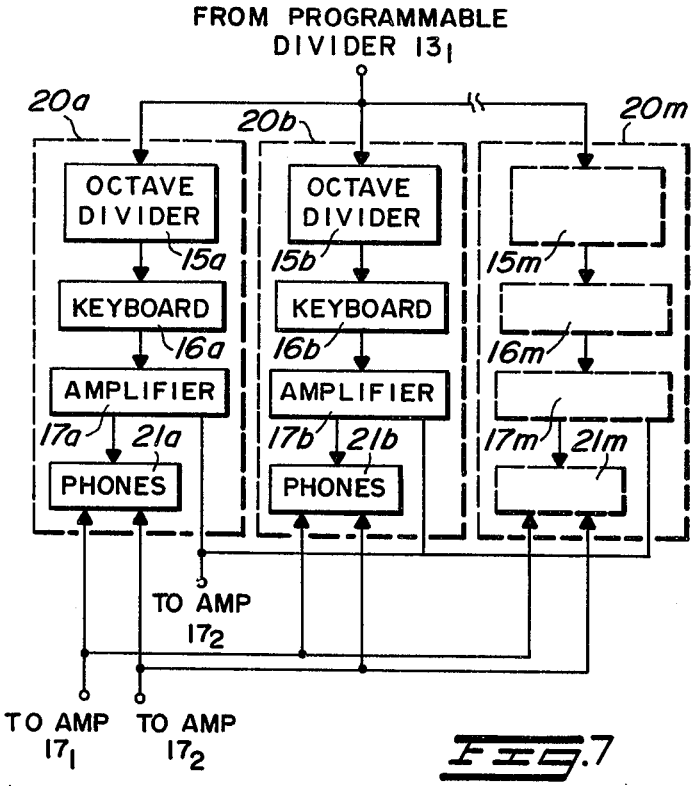
FIG. 7 is another embodiment of the invention showing slave units with connections to master unit 10.
Figure 6:
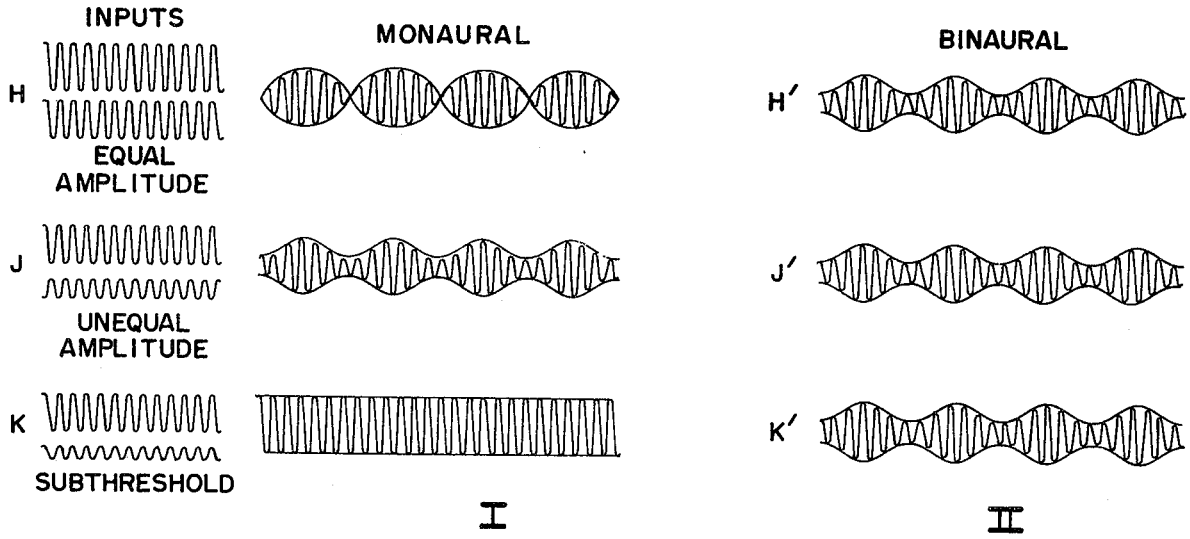
FIG. 6 is a chart of wave forms comparing the results in the brain of using monaural and binaural beats.

FIG. 6 shows graphically some of the differences between monaural beats and binaural beats as perceived by the auditory system in the brain. In each of the examples, as H and H′, identical signals are being used but in the monaural case the signals are mixed before they reach the ears of the subject. In the binaural case, the signals are presented to the ears separately. Lines H and H′ show the beats heard when two signals, close in frequency and of equal amplitude, are heard. Lines J and J′ show beats from inputs of unequal amplitude. In Lines K and K′, one input signal is definetely perceptible and the other below the threshold of hearing. (Note: the resultant wave shapes of monaural and binaural listening are not drawn to the same scale. Monaural beats are much more perceptible than binaural beats.) as may be seen, monaural beats vary greatly with the levels of the two input signals, whereas binaural beats tend to remain constant as one signal gets smaller, even to a point below the threshold of hearing. This type of experiment can be done readily with the present invention using any two of the programmable dividers $13_1$. . . $13_n$. One portion of one divider would be programmed with the desired frequency by the corresponding portion of its programmer 14. The appropriate switch of keyboard 16 would be depressed and the output of the corresponding amplifier 17 would be connected through the appropriate output terminals of the amplifier 17 to one side of a good set of stereo headphones (not shown) for example feeding the signal to one ear of the subject. A second programmable divider portion, chosen from another divider would similarly provide a second signal close in frequency to the first, to the other ear of the subject. Subjective measurements are then made as indicated in FIG. 6. The advantage of doing this experiment with the present invention is the exact control over the two pitches (in increments of approximately 1 cent) and their phase relationship. FIG. 7 is another embodiment of the invention, the augmentation of the master unit 10 with numerous slave units $\mathbf{20}_a$. . . $\mathbf{20}_m$ to form a music laboratory with added capabilities for teaching. Parts of the slave units comparable to parts of the master unit are shown with the same reference number but with alphabetic subscripts. Each slave unit $\mathbf{20}_a$. . . $\mathbf{20}_m$ receives an input of twelve signals from the programmable divider 13, of the master unit. This signal is then divided down in octave divider $\mathbf{15}_a$ . . . $\mathbf{15}_m$ to the lower octaves and fed to the keyboard $\mathbf{16}_a$ . . . $\mathbf{16}_m$ as is done in the master unit 10. The output of each keyboard goes to its amplifier $\mathbf{17}_a$ . . . $\mathbf{17}_m$. An output of the amplifier $\mathbf{17}_a$ . . . $\mathbf{17}_m$ leads to the amplifier 17, of the master unit (for monitoring purposes). Another output of amplifier $\mathbf{17}_a$ . . . $\mathbf{17}_m$ leads to the headphones $\mathbf{21}_a$ . . . $\mathbf{21}_m$ (worn by the student). One or more of the amplifiers $\mathbf{17}_2$. . . $\mathbf{17}_m$ of the master unit feed signals to the headphones of the slave unit also (for teaching and reference purposes).

What is claimed is:

1. In an electronic musical instrument for playing scales including those with more than twelve tones per octave and those with unequal temperament, a master programmable unit comprising:

oscillator means for providing a fixed reference frequency signal; and a plurality of individually programmable sections, each said programmable section having capability for producing twelve tones per octave independently of any other programmable section, and each including at least twelve divider chains connected to said oscillator means for receiving said fixed reference frequency signal and for producing simultaneously a first twelve distinct signals from said reference frequency signal, the divisor number of each said divider chain being adjustable and the divisor number of one of said divider chains being related to the divisor number of any second one of said chains by a factor greater than one and less than two, program means connected to said frequency divider chain for changing the divisor numbers of individual chains to vary the frequencies of said first twelve distinct signals, octave divider means connected to receive said first twelve distinct signals from said twelve divider chains and to produce therefrom at least a second twelve signals, each of the second twelve signals having a frequency related to the frequency of one of said first twelve signals by a multiple of two, and said octave divider means having an output for each of said second twelve signals, reproducing means for receiving and reproducing signals applied thereto, and having a multiplicity of output terminals, and switching means having at least twelve key switches, each key switch connected to an output of said divider means, for coupling the signal from said divider means output to said reproducing means.

2. A device as recited in claim 1 wherein each said divider chain includes a plurality of binary dividers connected to form a binary counter, and each portion of the program means includes feedback means connected to the output and the binary dividers of the chain, said feedback means having variable interconnection means for selectively connecting the output of the chain to predetermined binary counters of said chain to establish a selected divisor number for the chain.

3. A device as recited in claim 1, further including a plurality of slave devices, each comprising:

octave divider means connected to receive said first twelve distinct signals from the twelve divider chains and to produce therefrom at least a second twelve signals, each of said second twelve signals having a frequency related to the frequency of one of said first twelve signals by a multiple of two, and said octave divider having at least an output for each of said second signals, amplifier means for receiving signals applied thereto, and having a multiplicity of output terminals, switching means having at least twelve key switches, each key switch connected to an output of said divider means, for coupling the signal from said divider means output to said amplifier means, transducer means for receiving an input from said amplifier means and providing an audio output therefrom.

4. A device as recited in claim 3, further including means connecting an output of the amplifier of the slave unit to an amplifier in the reproducing means of the master unit for monitoring purposes.

5. A device as recited in claim 3, further including means connecting an output of an amplifier in the reproducing means of the master unit to the transducer means of the slave unit for instructional purposes.

* * * * *